US008104769B2

(12) United States Patent
Halling

(10) Patent No.: US 8,104,769 B2
(45) Date of Patent: Jan. 31, 2012

(54) BI-DIRECTIONAL WELLHEAD SEAL

(75) Inventor: Horace P. Halling, Durham, CT (US)

(73) Assignee: Seal Science & Technology, LLC, Durham, CT (US)

( * ) Notice: Subject to any disclaimer, the term of this patent is extended or adjusted under 35 U.S.C. 154(b) by 0 days.

(21) Appl. No.: 12/635,883

(22) Filed: Dec. 11, 2009

(65) Prior Publication Data

US 2010/0148447 A1 Jun. 17, 2010

Related U.S. Application Data

(60) Provisional application No. 61/138,344, filed on Dec. 17, 2008.

(51) Int. Cl.
*E21B 33/128* (2006.01)
*F16L 21/04* (2006.01)

(52) U.S. Cl. ..... 277/342; 277/522; 277/618; 277/622

(58) Field of Classification Search ..... 277/342, 277/522, 618, 621
See application file for complete search history.

(56) References Cited

U.S. PATENT DOCUMENTS

| | | | | | |
|---|---|---|---|---|---|
| 2,181,748 | A | * | 11/1939 | Thaheld | 277/342 |
| 2,217,038 | A | * | 10/1940 | Alley | 277/342 |
| 2,567,479 | A | * | 9/1951 | Hebard | 277/329 |
| 3,002,772 | A | * | 10/1961 | Schustack | 285/369 |
| 3,218,051 | A | * | 11/1965 | Doetsch | 267/129 |
| 3,467,394 | A | * | 9/1969 | Bryant | 277/308 |
| 3,767,215 | A | * | 10/1973 | Brown | 277/638 |
| 3,901,517 | A | * | 8/1975 | Heathcott | 277/556 |
| 4,194,582 | A | * | 3/1980 | Ostertag | 175/321 |
| 4,288,082 | A | * | 9/1981 | Setterberg, Jr. | 277/342 |
| 4,296,806 | A | * | 10/1981 | Taylor et al. | 166/120 |
| 4,298,562 | A | * | 11/1981 | Latty | 264/103 |
| 4,328,974 | A | * | 5/1982 | White et al. | 277/308 |
| 4,384,730 | A | | 5/1983 | Diehl | |
| RE31,933 | E | * | 7/1985 | Taylor et al. | 166/120 |
| 4,759,409 | A | | 7/1988 | Gullion | |
| 4,796,922 | A | * | 1/1989 | Prichard | 285/26 |
| 5,028,056 | A | * | 7/1991 | Bemis et al. | 277/437 |
| 5,090,087 | A | * | 2/1992 | Hipple et al. | 15/317 |
| 5,163,692 | A | * | 11/1992 | Schofield et al. | 277/436 |
| 5,180,008 | A | | 1/1993 | Aldridge et al. | |
| 5,630,591 | A | * | 5/1997 | Drijver et al. | 277/553 |
| 5,791,657 | A | | 8/1998 | Cain et al. | |
| 6,343,791 | B1 | * | 2/2002 | Anyan et al. | 277/337 |
| 6,510,895 | B1 | | 1/2003 | Koleilat et al. | |
| 7,011,312 | B2 | * | 3/2006 | Ishida | 277/342 |
| 7,401,788 | B2 | * | 7/2008 | Williams et al. | 277/342 |
| 7,810,816 | B1 | * | 10/2010 | Halling | 277/312 |
| 2008/0265517 | A1 | | 10/2008 | Jennings | |

* cited by examiner

*Primary Examiner* — Alison Pickard
(74) *Attorney, Agent, or Firm* — DeLio & Peterson, LLC; Robert Curcio

(57) ABSTRACT

A liquid and gas tight bi-directional metal frustro-conical seal is energized by compression between planar, annular faces causing its inner and outer diameters to sealingly engage opposing cylindrical surfaces of inner and outer metal pipes. The contact forces between the concentric sealing surfaces are high in order to locally deform the softer metal and eliminate leakage paths. The sealing ring is backed-up by a similar ring that is reduced in cross-sectional width, such that when compressed the ring does not engage the inner and outer cylindrical surfaces. The second ring is nested with and directly below the sealing ring, and equally axially compressed when the joint is assembled. When the pipe joints are disassembled, the second ring serves to restore the seal ring to its original, deeper frustro-conical shape, allowing the pipe joints to be easily separated for reuse of the piping in a different location.

11 Claims, 4 Drawing Sheets

BI-DIRECTIONAL WELLHEAD SEAL

CROSS REFERENCE TO RELATED APPLICATION

This application claims priority to U.S. Provisional Application No. 61/138,344, filed on Dec. 17, 2008.

BACKGROUND OF THE INVENTION

1. Field of the Invention

The present invention relates to seals in general, and specifically to compression seals. More specifically, the present invention relates to wellhead assemblies, and to an improved system, method and apparatus for forming a metal seal between inner and outer wellhead members. Ease of assembly and dismantling for reuse are desirable attributes.

2. Description of Related Art

A variety of metallic seal configurations exist. Many metallic seals are commonly held under compression between two opposed flanges of the elements being sealed to each other. Many examples of metallic seals are of an annular configuration, having a convoluted radial section which permits the seal to act as a spring and maintain engagement with the flanges despite changes or variations in the flange separation. Some of these seals have an S-like section, while others have a section similar to the Greek capital letter sigma (Σ), with diverging base and top portions. Other seals are formed with additional convolutions.

Non-provisional U.S. patent application Ser. No. 11/610,220, filed Dec. 13, 2006, by Hailing, entitled, "SEAL," and incorporated by reference herein, teaches the use of metal seals and, in particular, the use of frustro-conical rings with a rounded-trapezoidal seal cross-section having two parallel sides, for large wellheads, usually provided with hydraulically-actuated systems for assembling and dismantling piping joints therein. For smaller wellheads, such functions must be performed by screw-threaded devices or smaller, radially-disposed hydraulic tools.

Further descriptions of the prior art are cited and illustrated by Jennings, published in U.S. Publication No. 2008/0265517 A1, entitled, "SYSTEM, METHOD, AND APPARATUS FOR ENERGIZABLE METAL SEALS IN WELL HEADS."

SUMMARY OF THE INVENTION

Bearing in mind the problems and deficiencies of the prior art, it is therefore an object of the present invention to provide a bi-directional wellhead seal which prevents leakage of liquid and gas especially for small wellheads.

It is another object of the present invention to provide a bi-directional wellhead seal which is easily disassembled.

Still other objects and advantages of the invention will in part be obvious and will in part be apparent from the specification.

The above and other objects, which will be apparent to those skilled in the art, are achieved in the present invention which is directed to a bi-directional wellhead seal for sealing an inner pipe to a corresponding outer pipe comprising: a sealing ring including a shaped outside diameter having a frustro-conical upper surface and a lower surface; a spring ejector ring including a shaped outside diameter having a frustro-conical upper surface, the spring ejector ring outside diameter less than the sealing ring outside diameter, the spring ejector ring in mechanical communication with the sealing ring upon axial compression of the sealing ring.

In a second aspect, the present invention is directed to a compression seal co-axial pipes comprising: a sealing ring including a frustro-conical outside shape for engaging opposing cylindrical surfaces of the co-axial pipes, such that upon compression, the sealing ring is in mechanical communication with an outside diameter of an inner pipe, and in mechanical communication with an inside diameter of an outer pipe; and a spring ejector ring in contact with the sealing ring, the spring ejector ring including a frustro-conical outside shape of a diameter less than the sealing ring such that upon insertion and absent axial compression, the spring ejector ring forms a gap with the outside diameter of the inner pipe and a gap with the inside diameter of the outer pipe.

In a third aspect, the present invention is directed to a method for using a bi-directional wellhead seal comprising: providing an inner pipe having external threads on an upper end of the inner pipe and an abutment shoulder below the external threads; providing an outer pipe for sealing with the inner pipe; providing a sealing ring having a shaped outside diameter including a frustro-conical upper surface and a lower surface; providing a spring ejector ring maintaining axial pressure on the sealing ring lower surface upon axial compression of the rings, the spring ejector ring having a shaped outside diameter including a frustro-conical upper surface and having the outside diameter less than the sealing ring outside diameter; providing a sleeve nut having internal threads for attaching to external threads of the inner pipe; placing the spring ejector ring in contact with an abutment shoulder of the inner pipe; placing the sealing ring against the spring ring; and screwing the sleeve nut on the external threads of the inner pipe sufficient to deform the sealing ring such that the inner pipe and outer pipe are sealed from gas or fluid leakage.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE PREFERRED EMBODIMENT(S)

In describing the preferred embodiment of the present invention, reference will be made herein to FIGS. 1-5 of the drawings in which like numerals refer to like features of the invention.

Figure 1:
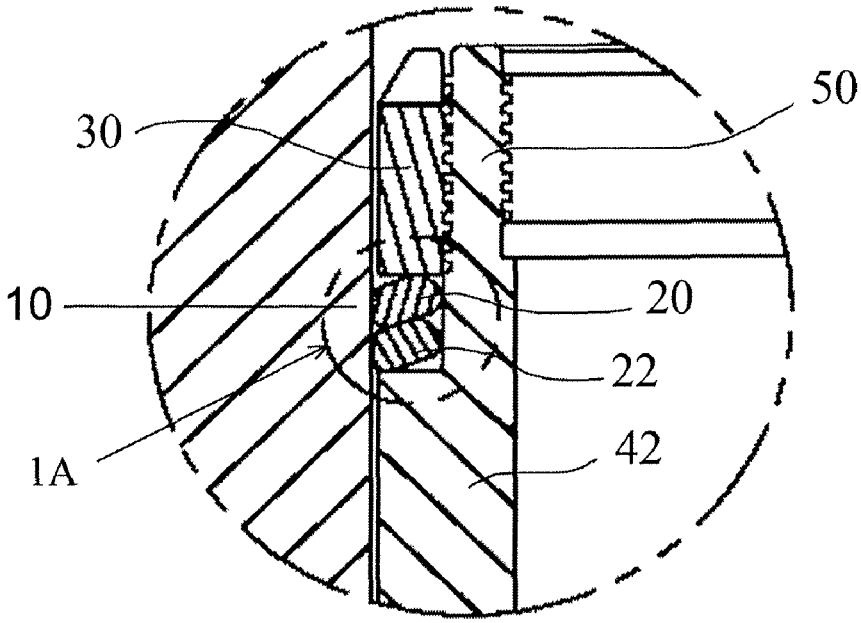
FIG. 1 is a cutaway cross section of the bi-directional wellhead seal according to the present invention.
Figure 1A:
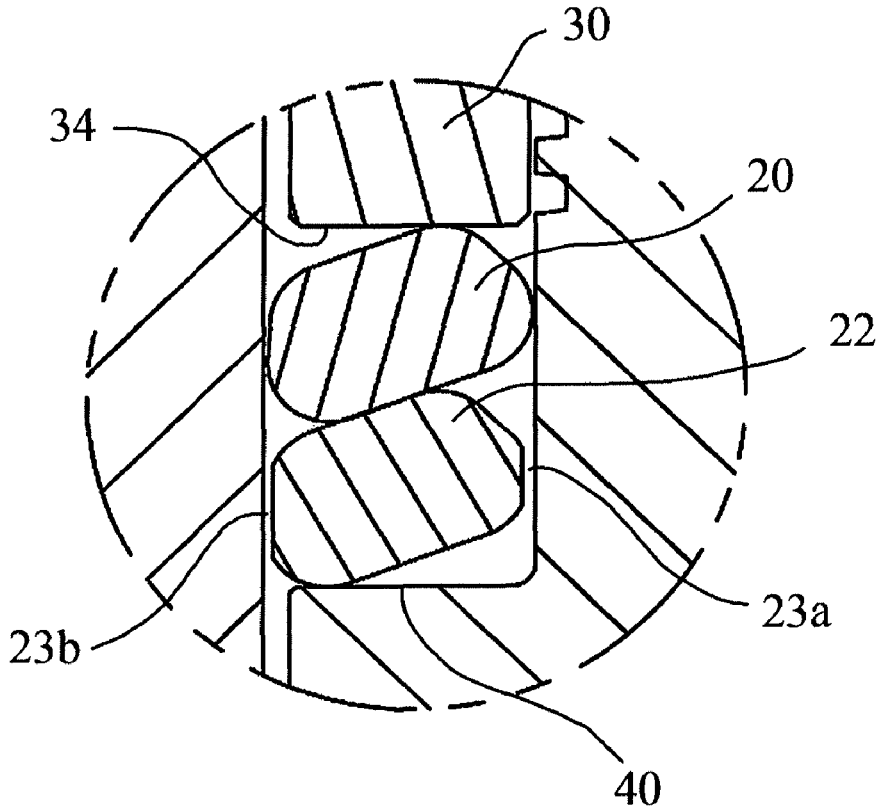
FIG. 1A is an enlarged view of the cross section of the seal shown in FIG. 1.

FIGS. 1 & 1A show a first embodiment of a bi-directional wellhead seal 10 according to the present invention. Wellhead seal 10 includes a one-piece, solid-section sealing ring 20 with a frustro-conical upper surface and lower surface. Seal 10 is compressed between the planar, annular face of an abutment shoulder 40 at the terminal end of a reduced end portion of an inner pipe 42 having a threaded section 50 at its distal end, and an internally-threaded sleeve nut 30 with driving and locking features engaging the threaded portion.

As illustrated in FIGS. 1 and 1A, in order to facilitate dismantlement of the joint after use, wellhead seal 10 is provided with a non-sealing spring ejector ring or spring backing ring 22 that will free sealing ring 20 when sleeve nut 30 is loosened or removed. FIG. 1A is an expanded view of wellhead seal 10 of FIG. 1 showing the wellhead joint with all components installed, axially touching but without preload tightening of sleeve nut 30. In this illustrative example, spring ejector ring 22 is identical with sealing ring 20 except for removal of some material from the inner and outer diameters, expressing a void or gap 23*a*, 23*b* to ensure that spring ejector ring 22 does not jam against the cooperating cylindrical surfaces of the pipes when sealing ring 20 and spring ejector ring 22 are compressed axially.

Figure 2:
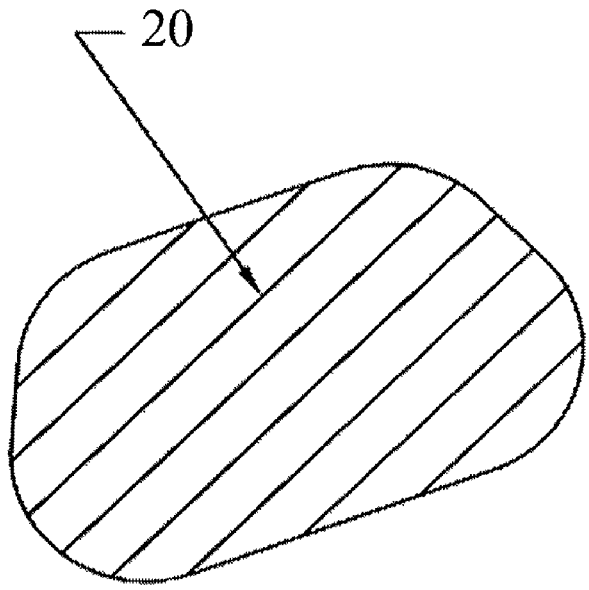
FIG. 2 is a cross sectional view of the seal ring according to the present invention.
Figure 3:
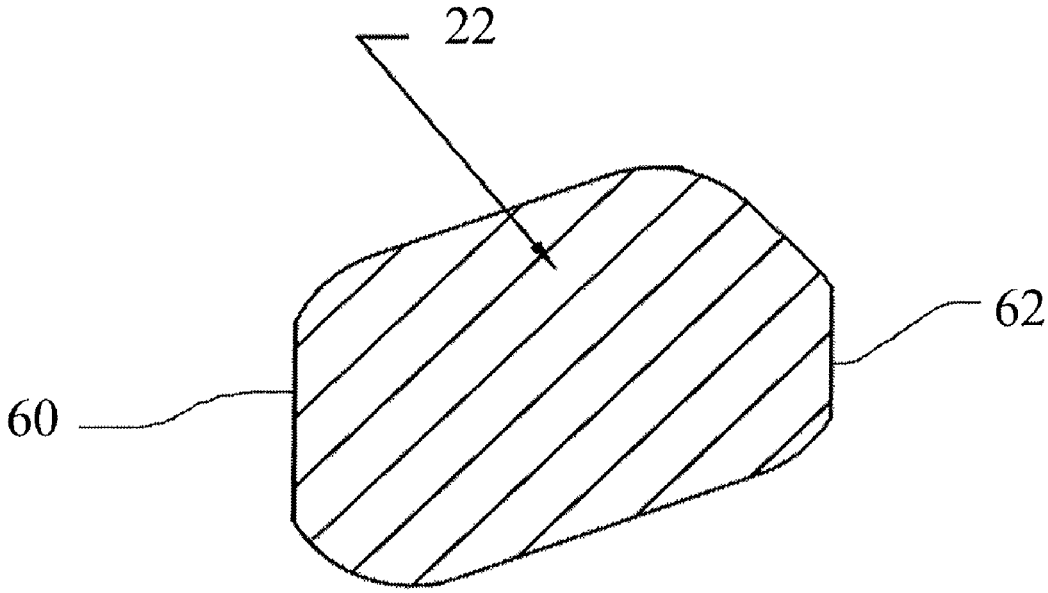
FIG. 3 is a cross sectional view of the spring backing ring according to the present invention.

As shown in the enlarged cross-sectional views of sealing ring 20 and spring ejector ring 22, in FIGS. 2 and 3 respectively, spring ejector ring 22 may be constructed from a sealing ring by removing material from the sealing ring to form the flat surfaces 60, 62. The cross section of spring ejector ring 22 may have other shapes and perform approximately as well, as will be apparent to those skilled in the art. Seal 10 may also be composed of different ring shapes without largely affecting the performance of the joint. For example, seals may be employed with curvatures having smaller or larger radii than currently illustrated. To construct spring ejector ring 22 from a sealing ring, material is removed from the outside and inside diameters of the sealing ring by lathe turning or grinding to produce a shape for spring ejector ring 22 as illustrated in the figures. Alternative approaches, such as the manufacture of a ring with a similar but smaller cross-section for spring ejector ring 22 will also be obvious to those skilled in the art, the only imperatives in the design of this component are its ability to generate sufficient force to eject sealing ring 20, and that contact between the two rings is at a position whereby the reaction force of spring ejector ring 22 when loaded tends to rotate sealing ring 20 in the desired direction.

Figure 4:
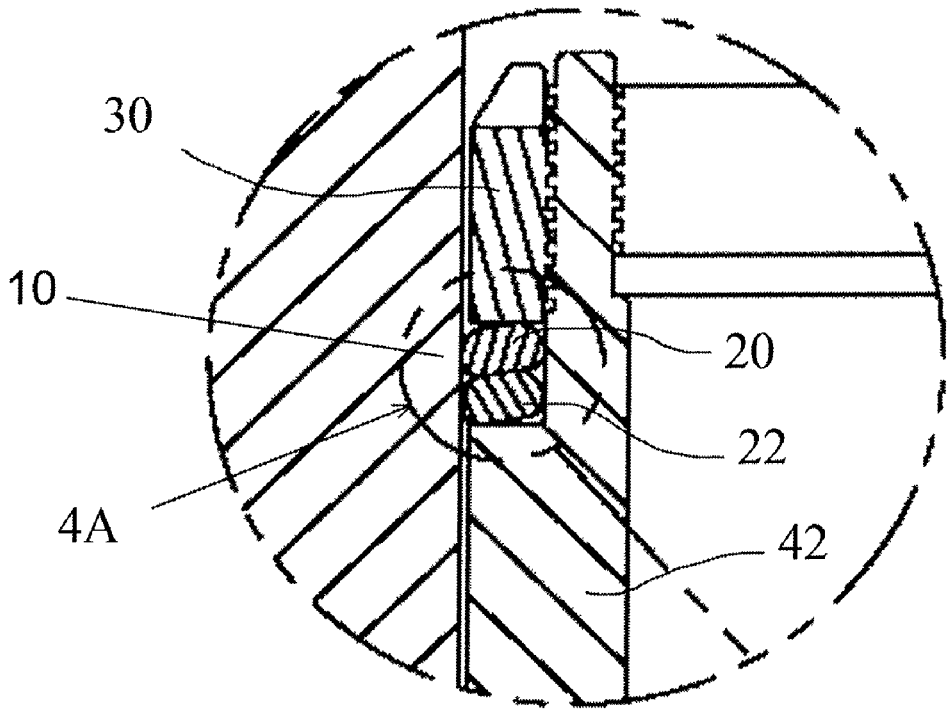
FIG. 4 is a cutaway cross section of the bi-directional wellhead seal under compression according to the present invention.
Figure 4A:
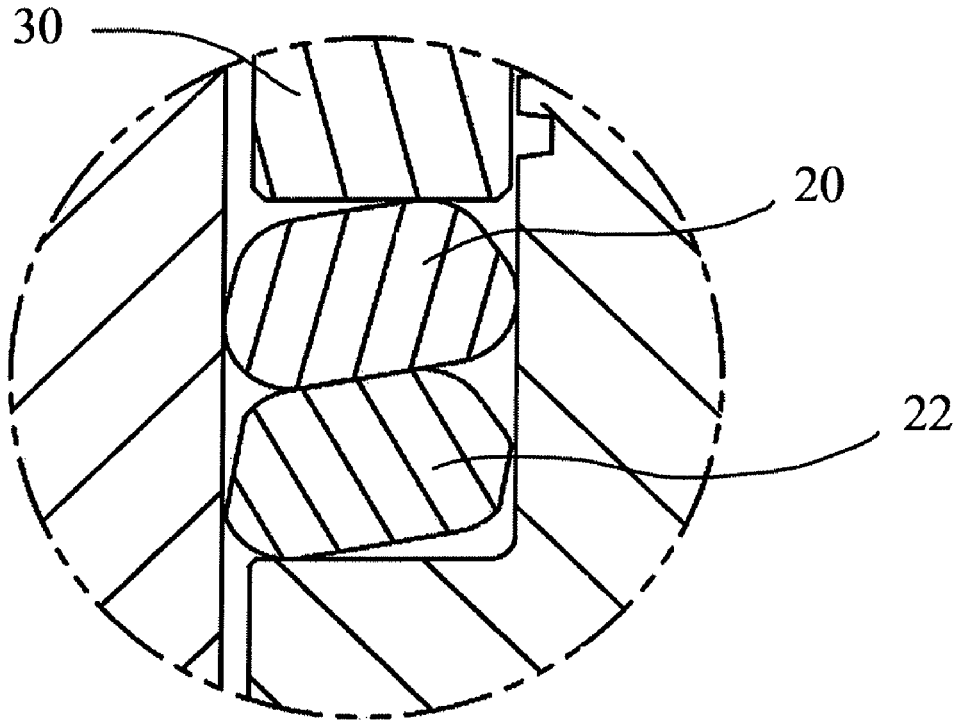
FIG. 4A is an enlarged view of the cross section of the seal shown in FIG. 4.

FIGS. 4 and 4A show bi-directional wellhead seal 10 in a preloaded, sealing condition. Sleeve nut 30 is tightened to a pre-determined torque level, at which point the inner and outer surfaces of sealing ring 20 are compressed against the cooperating cylindrical surfaces of the inner and outer pipes. Spring ejector ring 22 has been similarly compressed, but due to the removal or absence of material about its circumference, it is not in contact with either of the pipes. In the preloaded condition, a soft metal coating or softer parent metal of sealing ring 20 is locally deformed to fill all asperities and tool marks in the cooperating surfaces and achieves a gas-tight seal between the two pipes.

A searching, small molecule gas such as helium is employed at low pressure to check for leakage, for example, at about 25 psig to 50 psig. Because gas volumes needed to test long pipe "strings" would be prohibitively expensive if only helium were to be used, the gas is usually a mixture of helium and nitrogen, but the smaller molecular size of the helium makes it the leakage rate determinant.

The pipe joints are tested using oil and/or gas at very high pressures to simulate the operational uses of the piping systems conducting hydro-carbons. Such testing, including proof testing to provide a safety margin, may be conducted at pressures in excess of 10,000 psig.

After testing, which includes high pressure testing, the sealed joints must still be manually separable. Spring ejector ring 22 therefore must be capable of unseating the deformed surfaces of sealing ring 20 and assisting return of the sealing ring to its free state.

Figure 5:
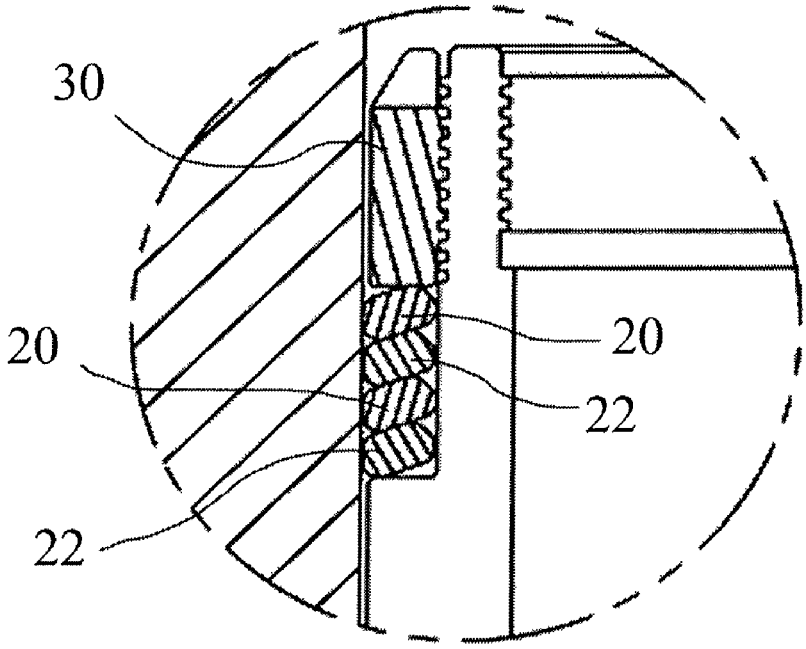
FIG. 5 is a cutaway cross section of a second embodiment of the bi-directional wellhead seal according to the present invention.
Figure 5A:
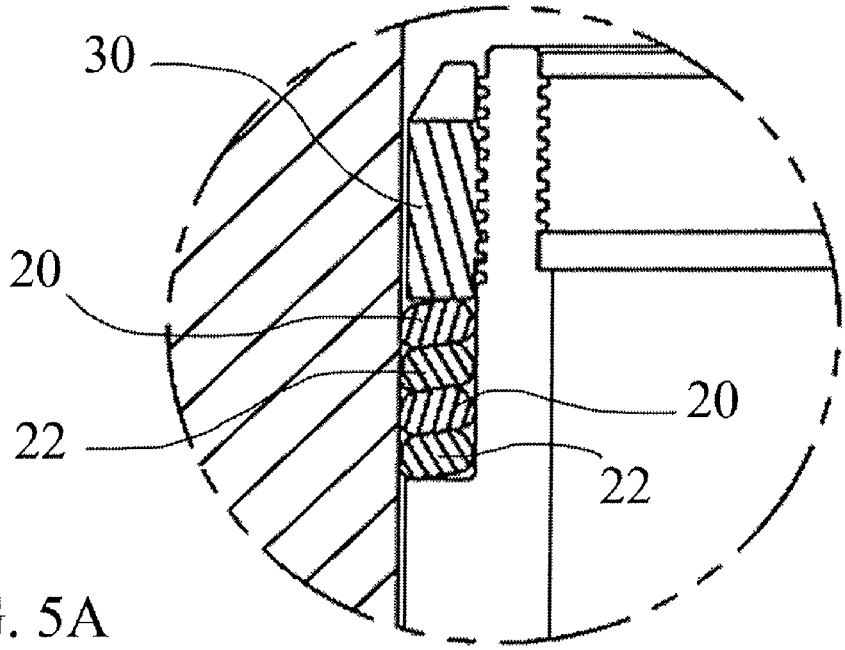
FIG. 5A is a cutaway cross section of a second embodiment of the bi-directional wellhead seal under compression according to the present invention.

FIGS. 5 & 5A illustrate a second embodiment, in which sealing rings 20 and spring ejector rings 22 are double-stacked. This design is preferred in cases where the quality of piping surfaces is questionable and a "series" sealing system is needed to assure adequate leakage control. FIG. 5 depicts the double-stacked seal with sleeve nut 30 in a loosened state. FIG. 5A depicts the seal with sleeve nut 30 tightened.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. A compression seal for co-axial pipes comprising:

a sealing ring including a frustro-conical outside shape for engaging opposing cylindrical surfaces of said co-axial pipes, such that upon compression, said sealing ring is in mechanical communication with an outside diameter of an inner pipe, and in mechanical communication with an inside diameter of an outer pipe; and a spring ejector ring in contact with and separable from said sealing ring, said spring ejector ring including a frustro-conical outside shape of a diameter less than said sealing ring such that upon insertion and absent axial compression, said spring ejector ring forms a gap with said outside diameter of said inner pipe and a gap with said inside diameter of said outer pipe, and generates sufficient force to eject said sealing ring upon removal of a sealing axial compression force.

2. The compression seal of claim 1 including having contact between said sealing ring and said spring ejector ring at a position whereby reaction force of said spring ejector ring when loaded will tend to rotate said sealing ring in a desired or predetermined direction.

3. The compression seal of claim 1 including having said sealing ring and said spring ejector ring in mechanical communication during axial compression such that said sealing ring forms a liquid- or gas-tight seal, or both.

4. The compression seal of claim 1 including multiple pairs of sealing rings and corresponding spring ejector rings axially aligned between inner and outer coaxial pipes.

5. The compression seal of claim 1 including having said spring ejector ring form a gap with said outside diameter of said inner pipe and a gap with said inside diameter of said outer pipe upon axial compression of said sealing ring and said spring ejector ring.

6. The compression seal of claim 1 including a sleeve nut for compressing said sealing ring upon rotation.

7. The compression seal of claim 6 wherein said sleeve nut includes internal threads for attaching to external threads of said inner pipe.

8. The compression seal of claim 1 wherein said sealing ring is comprised of resilient material.

9. The compression seal of claim 8 wherein said resilient material comprises metal.

10. The compression seal of claim 1 wherein said spring ejector ring is comprised of resilient material.

11. The compression seal of claim 10 wherein said resilient material comprises metal.

* * * * *